US006651580B2

(12) United States Patent
Lay et al.

(10) Patent No.: US 6,651,580 B2
(45) Date of Patent: Nov. 25, 2003

(54) METHOD AND SYSTEM FOR MOORING

(75) Inventors: Thomas Lay, Savoy (FR); Charles Springett, Houston, TX (US)

(73) Assignee: GlobalSantaFe Corporation, Dallas, TX (US)

( * ) Notice: Subject to any disclaimer, the term of this patent is extended or adjusted under 35 U.S.C. 154(b) by 0 days.

(21) Appl. No.: 10/080,481

(22) Filed: Feb. 22, 2002

(65) Prior Publication Data

US 2003/0159638 A1 Aug. 28, 2003

(51) Int. Cl.[7] ..... B63B 21/50
(52) U.S. Cl. ..... 114/293; 114/230.1; 114/230.23
(58) Field of Search ..... 114/230.1, 230.2, 114/230.23, 230.24, 230.26, 293, 264, 265

(56) References Cited

U.S. PATENT DOCUMENTS

| | | | | |
|---|---|---|---|---|
| 3,929,087 A | * | 12/1975 | Montgomery | 114/297 |
| 3,967,572 A | | 7/1976 | Lea | |
| 3,985,093 A | * | 10/1976 | Eidem | 114/230.23 |
| 4,446,807 A | * | 5/1984 | Johnson et al. | 114/230.23 |
| 4,517,913 A | | 5/1985 | Albertini et al. | |
| RE32,119 E | | 4/1986 | Abbott et al. | |
| 4,616,590 A | | 10/1986 | Albertini et al. | |
| 4,742,993 A | * | 5/1988 | Montgomery et al. | 226/196.1 |
| 4,995,762 A | | 2/1991 | Goldman | |
| 5,065,687 A | | 11/1991 | Hampton | |
| 5,222,453 A | | 6/1993 | Chabot | |
| 5,390,618 A | * | 2/1995 | Wolff et al. | 114/230.23 |
| 5,492,406 A | | 2/1996 | Meyer | |
| 5,566,636 A | | 10/1996 | Wolf et al. | |
| 5,779,226 A | | 7/1998 | Wudtke | |
| 5,944,448 A | | 8/1999 | Williams | |
| 5,984,586 A | | 11/1999 | Wudtke | |
| 6,148,755 A | | 11/2000 | Wudtke et al. | |
| 6,170,424 B1 | | 1/2001 | Boerseth | |

* cited by examiner

*Primary Examiner*—Sherman Basinger
(74) *Attorney, Agent, or Firm*—David W. Carstens; Carstens Yee & Cahoon LLP

(57) ABSTRACT

A mooring system that uses combination traction winch/windlass units is improved by adding an additional fairlead at each combination unit location and by increasing the strength of existing combination units, their foundations and the foundations of associated equipment such as fairleads and turning sheaves. By these relatively simple upgrades, the mooring capabilities of the system can be economically augmented in those situations where additional lines are desired, such as in areas subject to tropical revolving storms. Normal mooring, when there is no threat of hurricanes, has the anchor and chain attached to the floating structure by wire deployed from the traction winch. When storm season threatens, additional anchors attached to chain run over the windlass can be added, allowing the number of lines to be doubled. The additional anchors can be installed if the floating structure is conventionally moored or if it is attached to pre-set moorings.

18 Claims, 18 Drawing Sheets

METHOD AND SYSTEM FOR MOORING

TECHNICAL FIELD OF THE INVENTION

The present invention relates to an improved method of mooring floating offshore structures such as semi-submersible drilling rigs. Specifically, the invention relates to a method and apparatus for deploying additional mooring lines to secure a rig in anticipation of adverse weather conditions.

BACKGROUND OF THE INVENTION

Floating offshore structures, for example, semi-submersible drilling platforms, drill ships and the like, are used by the oil and gas industry in increasing water depths. Unlike platforms that sit on the seabed, these structures must have a means of keeping the structure within reasonable proximity of the well site; such a means can include a mooring system and/or a dynamic positioning system. While applicable to all types of floating offshore structures, the mooring system will be explained in terms of semi-submersible drilling platforms.

Semi-submersible drilling platforms are specialized vessels used to prospect for and produce oil and natural gas from the sea floor, and are especially useful when the water depth precludes the use of fixed structures on the ocean bottom. These rigs are very large and very expensive to construct, commonly costing hundreds of millions of dollars each.

As seen in the example of FIG. 1A, semi-submersible drilling platforms comprise three main parts: buoyant members 108, work section 109, and stability columns 111, which elevate work section 109 above the water level. Work section 109 contains or supports the equipment that is necessary for drilling and other related activities, as well as the living quarters for the crew. The platform is towed or proceeds under its own power between locations with buoyant members 108 floating on the surface, but once on location, the buoyant members are filled with seawater until the platform is partially submerged with the operating water level approximately mid way up the stability columns. In this example, a drilling derrick 102 and cranes 106 for handling large items are mounted on upper deck 104 of the work section 109. For the sake of simplicity, it will be understood that this drawing is not drawn to scale, nor does it begin to show the variety of equipment carried on such a platform. Mooring lines carried on the semi-submersible drilling platform are shown deployed. These mooring lines typically consist of a length of chain, which is attached at one end to the anchor and at the opposite end to a steel cable (also referred to as wire rope). The cable is attached to a traction winch, which provides necessary tension, and is stored on a remotely located storage reel. The chain in the mooring line provides weight near the anchor, so that force applied to the anchor is always in a horizontal direction. Cable, on the other hand, provides a better strength to weight ratio, so that the strength of the line is not all used in simply supporting the length of line in the water.

FIG. 1B is a close-up of the onboard hardware for the mooring system. Chain for the anchor is carried in chain lockers 116, while cable is carried on a spool 122. A combination traction winch/windlass 120 is positioned on upper deck 104 to enable handling of the cable and chain. Traction winch/windlass 120 has three major components, some of which are better seen in FIG. 1C, which shows a side of the semi-submersible adjacent the side seen in FIG. 1A. The three components are traction winch 120A, which handles and tensions the wire rope 118, windlass 120B, which handles and tensions the chain 114, and shaft 120C, which, combined with an electric motor (not shown), provides the drive power to run the other two components. Anchors 110 are normally carried by the semi-submersible drilling platform already attached to chain 114 and positioned on structures known as anchor bolsters 124. From its attachment to the anchor 110, chain 114 is led under fairlead 112, then over the windlass 120B to the chain locker 116, with the chain and windlass holding the anchors in place. Each rig will be equipped with enough chain and cable to handle a given depth of water. In this example, the semi-submersible drilling platform carries enough chain and cable for water depths up to approximately 5,000 feet, although this value can vary according to design. Platform 175 is located on the stability column below the traction winch and provides a location and facilities for connecting the chain to the wire when the chain has been run out and the anchor line is transferred from the windlass to the traction winch. These systems will be explained in greater detail, shortly.

Depending on the water depth and the operator's choice, the platform can be moored either by using the system that is carried onboard, or by utilizing pre-set anchors, such as suction pile anchors or deep embedded anchors connected to mooring lines comprising some combination of chain, wire rope and synthetic rope and with the free end supported by a floating buoy. In water depths greater than the platform is equipped for (5,000 feet in our example), pre-set anchors must be utilized, but in shallower water, either system can be used. For example, the operator may want to begin drilling as soon after the arrival of the rig as possible. In this instance, they may choose preset anchors, as much of the time necessary to set the anchors can take place before the rig arrives on site.

FIG. 2 shows an exemplary deployment of the mooring system of a drill platform, as seen from a birds-eye view. Drill rig 102 and cranes 106 are seen, as are traction winch/windlasses 120. Each comer has two combination traction winch/windlasses 120 run from a single shaft through clutches, with their mooring lines generally placed 45 degrees from each other and arranged symmetrically around the platform. However, it should be understood that this is only one possible arrangement of mooring lines, and even this example may be biased to resist environmental forces, such as wind and waves, which may be stronger from one direction than from another.

Setting the onboard anchor is demonstrated with reference to FIGS. 3A and 3B. A chaser line 310, attached to anchor/chain 110/114, is given to an anchor handling boat 300. This chaser line 310 encircles the anchor and chain, and as boat 300 moves away from platform 100, anchor 110 is freed from its bolster 124. The boat steams away from the rig until sufficient chain 114 has been deployed. The anchor chain 114A is then separated at platform 175 from the chain 114B in chain locker 116 and attached to the connector 176 on the free end of the wire rope running over the traction winch. One method of handling this change from chain to cable is shown in U.S. Pat. No. 3,967,572 to Santa Fe International Corporation, titled "Anchoring System and Chain Stopper Therefor", which is hereby incorporated by reference. After the anchor chain 114A is attached to wire rope 118 at connector 176, boat 300 continues to steam away from the rig until the traction winch pays out the required amount of wire. The boat then lowers anchor 110 on chaser wire 310 until it reaches the seabed; then the rig tensions up the mooring line with the traction winch 120A to set the anchor 110. In FIG. 3B, the boat returns the chaser and chaser line 310 to the rig.

FIG. 4 demonstrates the conventional way of connecting to a preset anchor. Preset anchor 420 has been previously placed in position, with a mooring line 425 of some combination of chain, wire rope, and synthetic rope. Buoy 410, is attached to the mooring line to mark the location of the anchor and to support the free end of the mooring line. When platform 100 is to be attached to preset anchors, onboard anchor 110 must first be removed from the chain 114 and stored and the chain removed from the fairlead 112. Then wire rope 118 is led from traction winch 120A through fairlead 112 and given to an anchor handling boat 300. The boat runs the end of the wire out to the buoy and attaches wire rope 118 to the mooring line 325 on anchor 320. Once these are connected, the traction winch 120A takes up the slack.

As semi-submersible drilling units become larger, environmental loads on the units increase and the size of mooring lines and anchors must increase also. To offset this tendency, multiple thrusters (not shown) can relieve peak loads during storms, so that normal mooring components can be kept to a reasonable size.

While the mooring systems described above are capable of maintaining the platform's position under normal conditions, the platform can be subjected to intense weather conditions in those parts of the world that are subject to tropical revolving storms (TRS), such as the Gulf of Mexico. It is not practical to reposition the rigs to avoid such storms, nor is it possible to utilize thruster systems if the operating policy is for personnel to be evacuated ahead of major storms. In the past, the risk of losing the rig during the storm (hurricane) was mitigated by the fact that no personnel were on board and human life was not endangered. Today, however, rigs have become larger as drilling moves into deeper water and the risk of a mooring failure has increased, due to both the increase in water depth and the larger environmental loads. The complexity and cost of the infrastructure necessary to operate in deep water has also increased, so there is a need to devise a mooring system that will prevent a rig from breaking free in a storm and from dragging an anchor and destroying nearby support and/or production structures. One solution would be to make the normal mooring systems stronger, so that they could withstand the environmental forces generated by tropical revolving storms. However, not only would the onboard equipment have to be made considerably bigger, stronger and more expensive to handle these forces, but related machinery, such as the anchor-handling boats, would also have to be made larger to handle larger anchors and to pull out heavier chain and wire. Economically, this is not a desired solution. To minimize costs to the operator, the need exists for means to economically supplement a conventionally sized mooring system to provide additional support during the season for tropical revolving storms.

SUMMARY OF THE INVENTION

The present invention relates to an improved mooring system in which additional mooring lines can be deployed without the need for a complete set of additional mooring winches. Existing traction winch/windlass devices have the capability to handle both wire and chain mooring lines, but once the anchors are deployed, only the traction winch is utilized to apply tension to the mooring lines. In implementing an embodiment of the present invention, additional fairleads are added to the mooring system to increase the capacity of the mooring system, while the specifications for the combination traction winch/windlasses are increased so that this equipment can handle the simultaneous load of a mooring line on the traction winch and a mooring line on the windlass. Using these additional capabilities, the normal mooring lines connected to the traction winches can be supplemented in hurricane season by additional mooring lines, which are run over the windlass. This solution does not require the heavier cable and chain of other suggested solutions, nor does it require heavier support boats to implement. Other than the increase in the required strength of the traction winch/windlass frame, this solution only requires that one additional fairlead be added adjacent each of the existing fairleads.

BRIEF DESCRIPTION OF THE DRAWINGS

The novel features believed characteristic of the invention are set forth in the appended claims. The invention itself, however, as well as a preferred mode of use, further objects and advantages thereof, will best be understood by reference to the following detailed description of an illustrative embodiment when read in conjunction with the accompanying drawings, wherein:

FIG. 8A shows an alternate embodiment of the invention with only the normal lines deployed, while

DETAILED DESCRIPTION OF THE PREFERRED EMBODIMENT

The innovative mooring system will now be discussed with reference to FIGS. 5A through 7C.

Figure 1A:
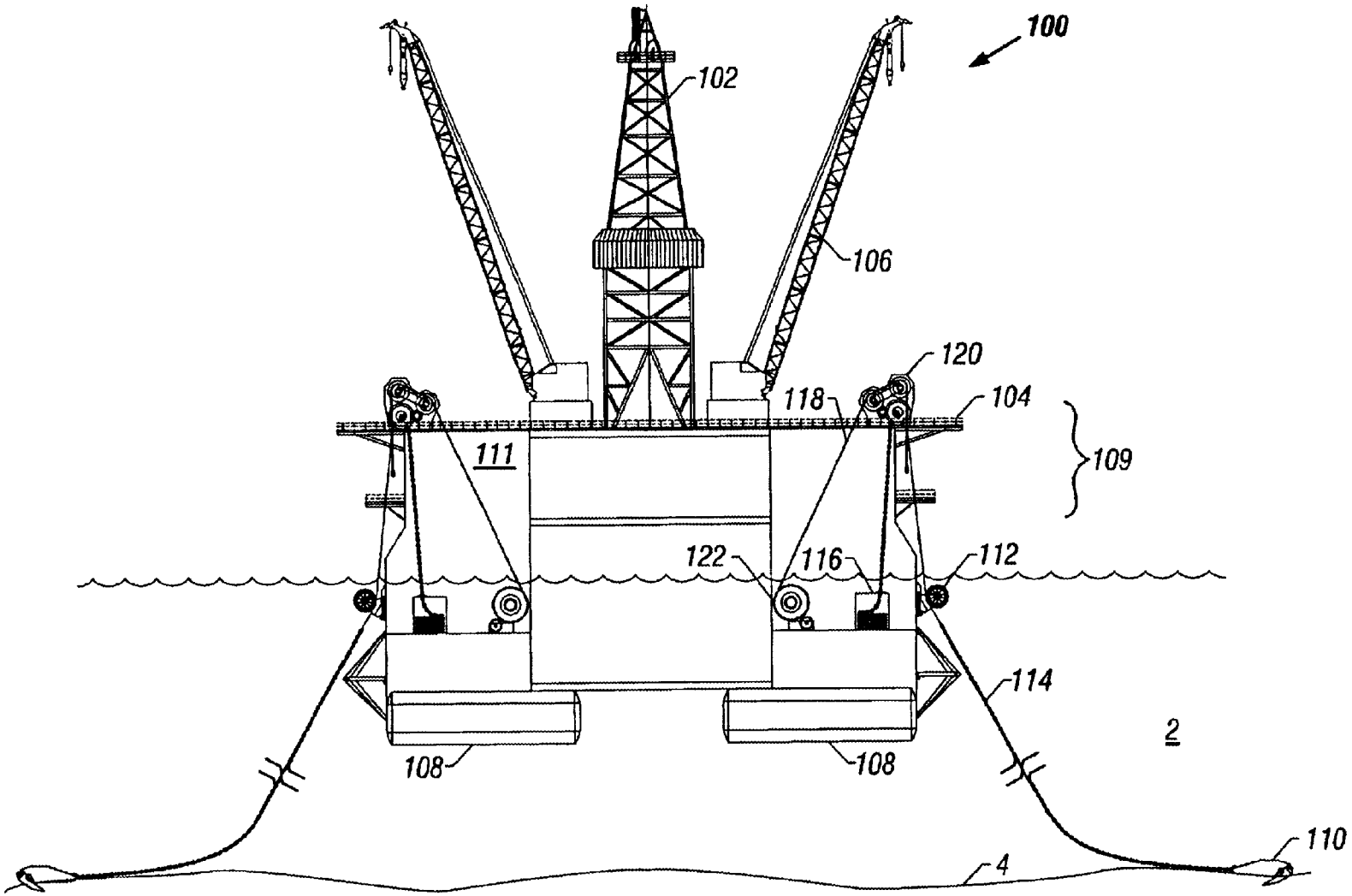
FIG. 1A (Prior Art)
FIG. 1A is a partial cut-away view of a semi-submersible drilling platform, demonstrating a conventional mooring system.
Figure 1B:
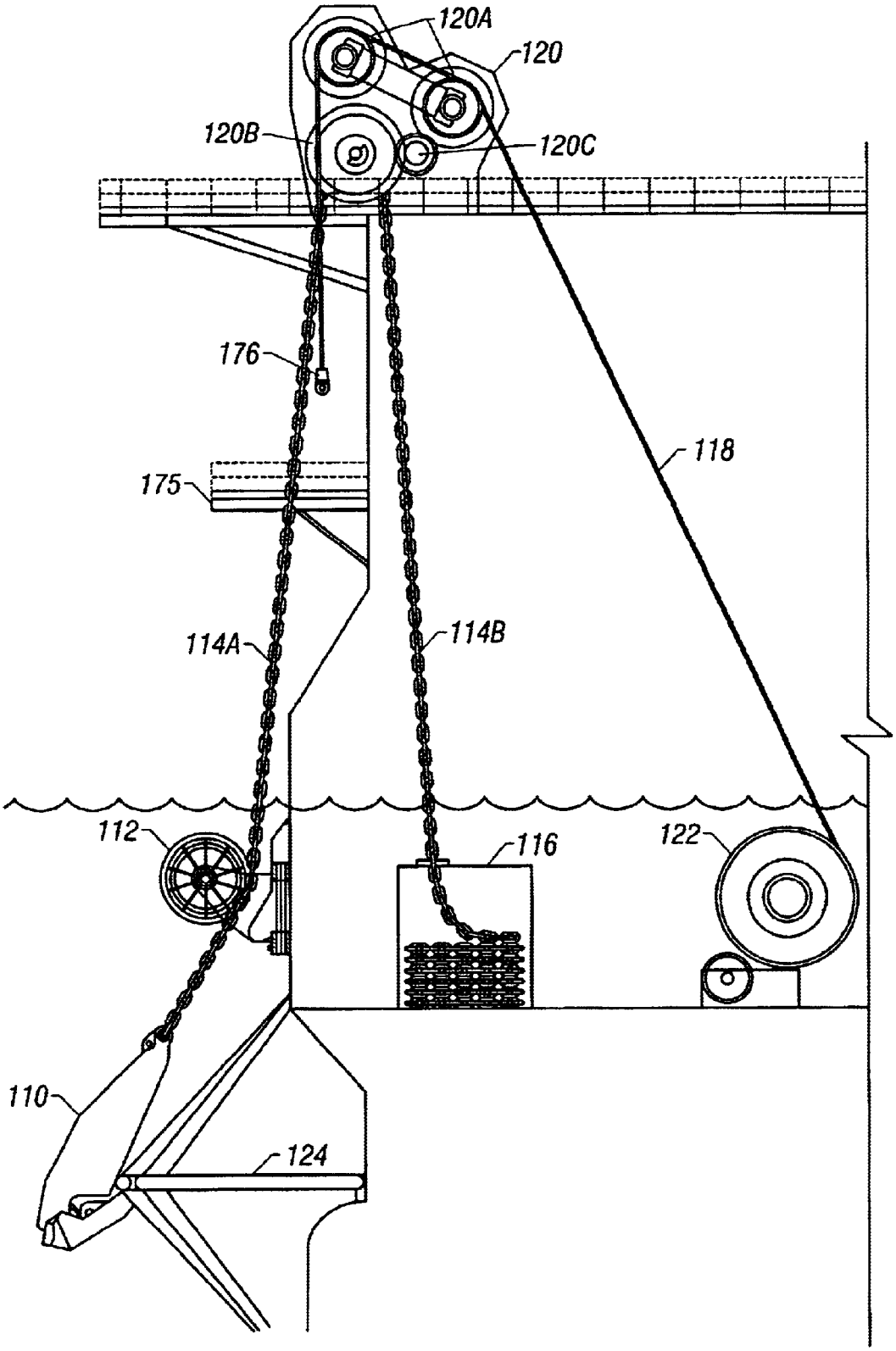
FIG. 1B (Prior Art)
FIG. 1B is a close-up view of the hardware that is carried on board the drilling platform for the mooring system.
Figure 1C:
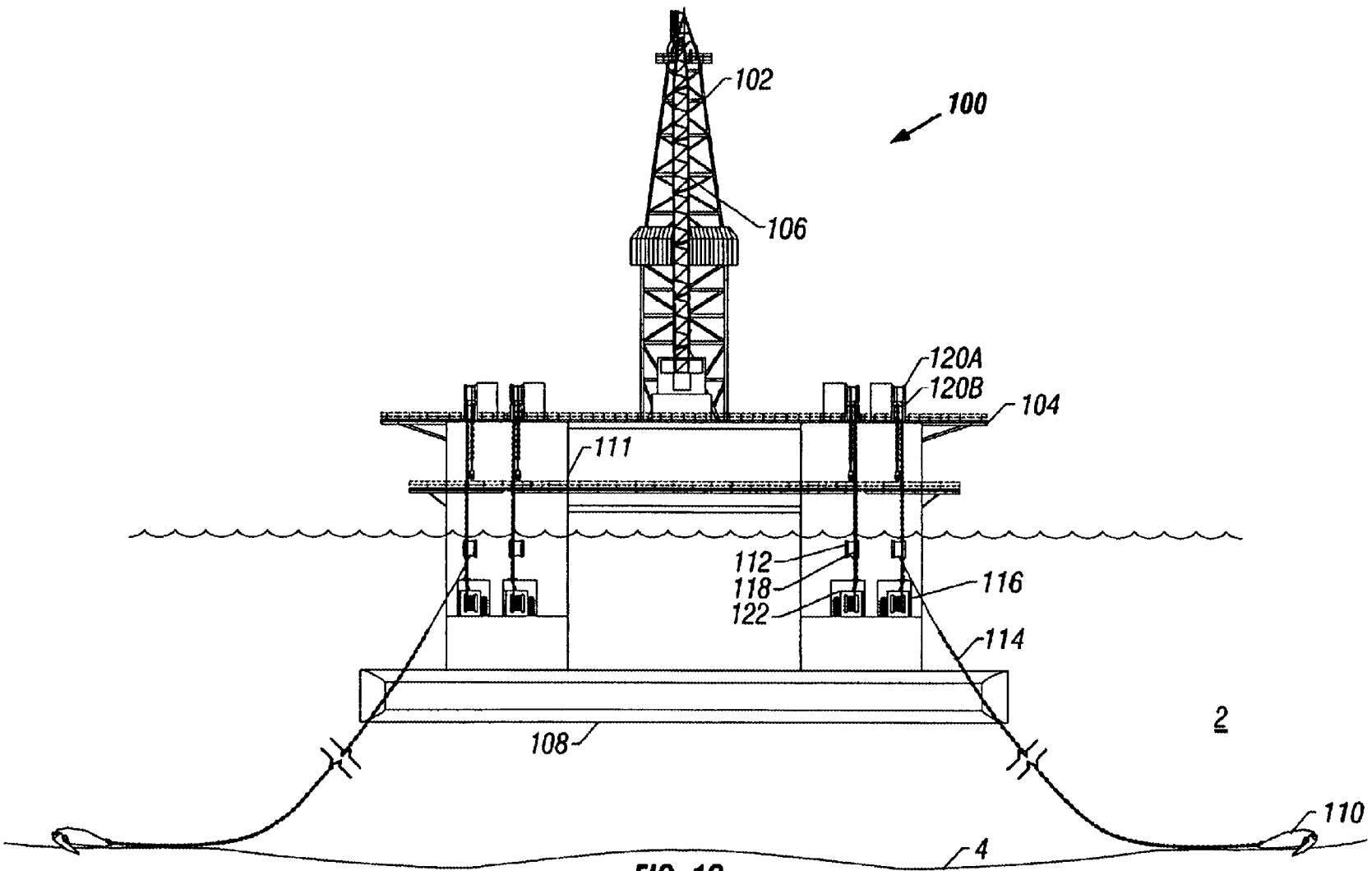
FIG. 1C (Prior Art)
FIG. 1C is a partial from a side adjacent the side seen in FIG. 1A.
Figure 2:
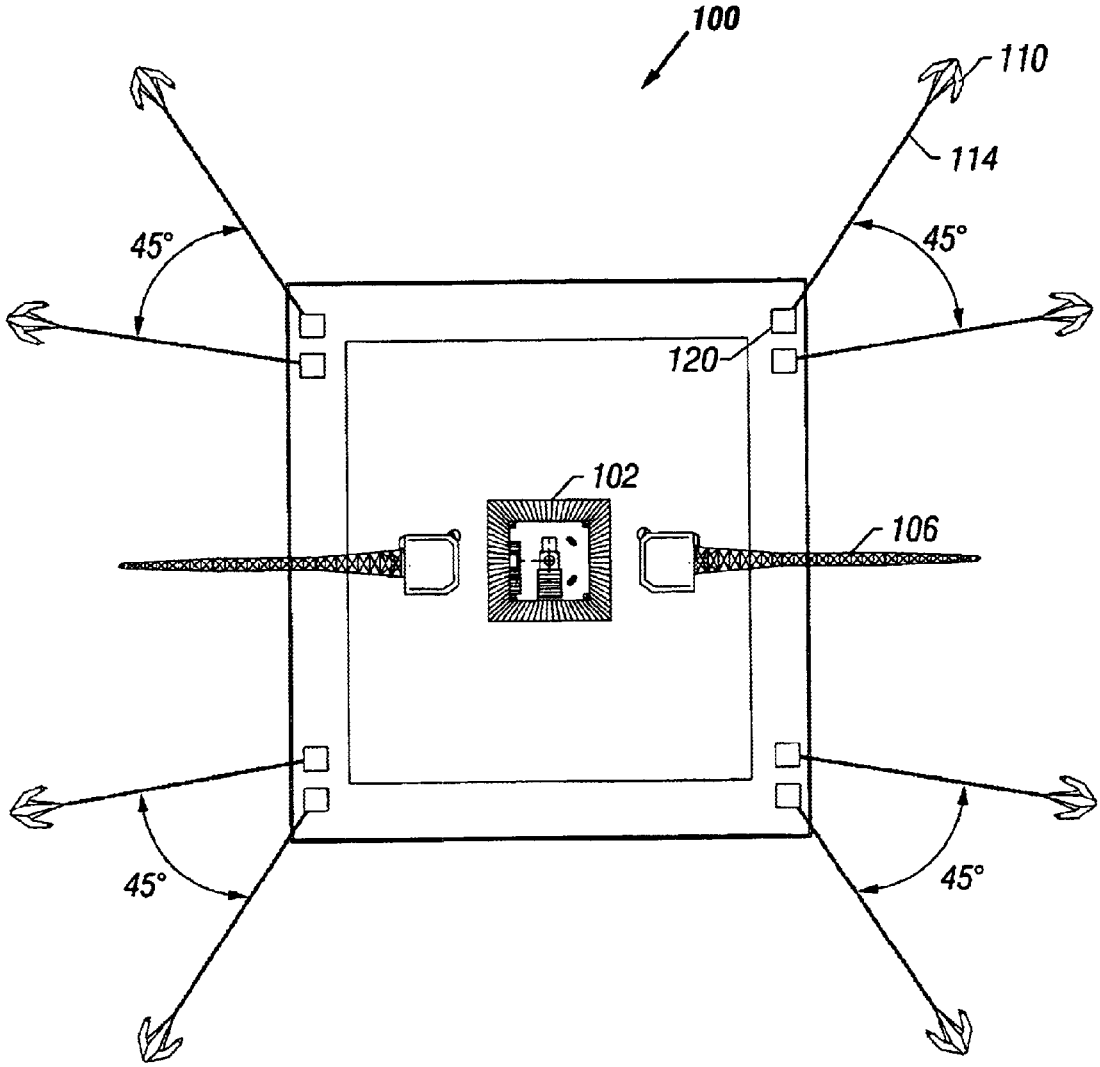
FIG. 2 (Prior Art)
FIG. 2 is a view from above the drilling platform.
Figure 3A:
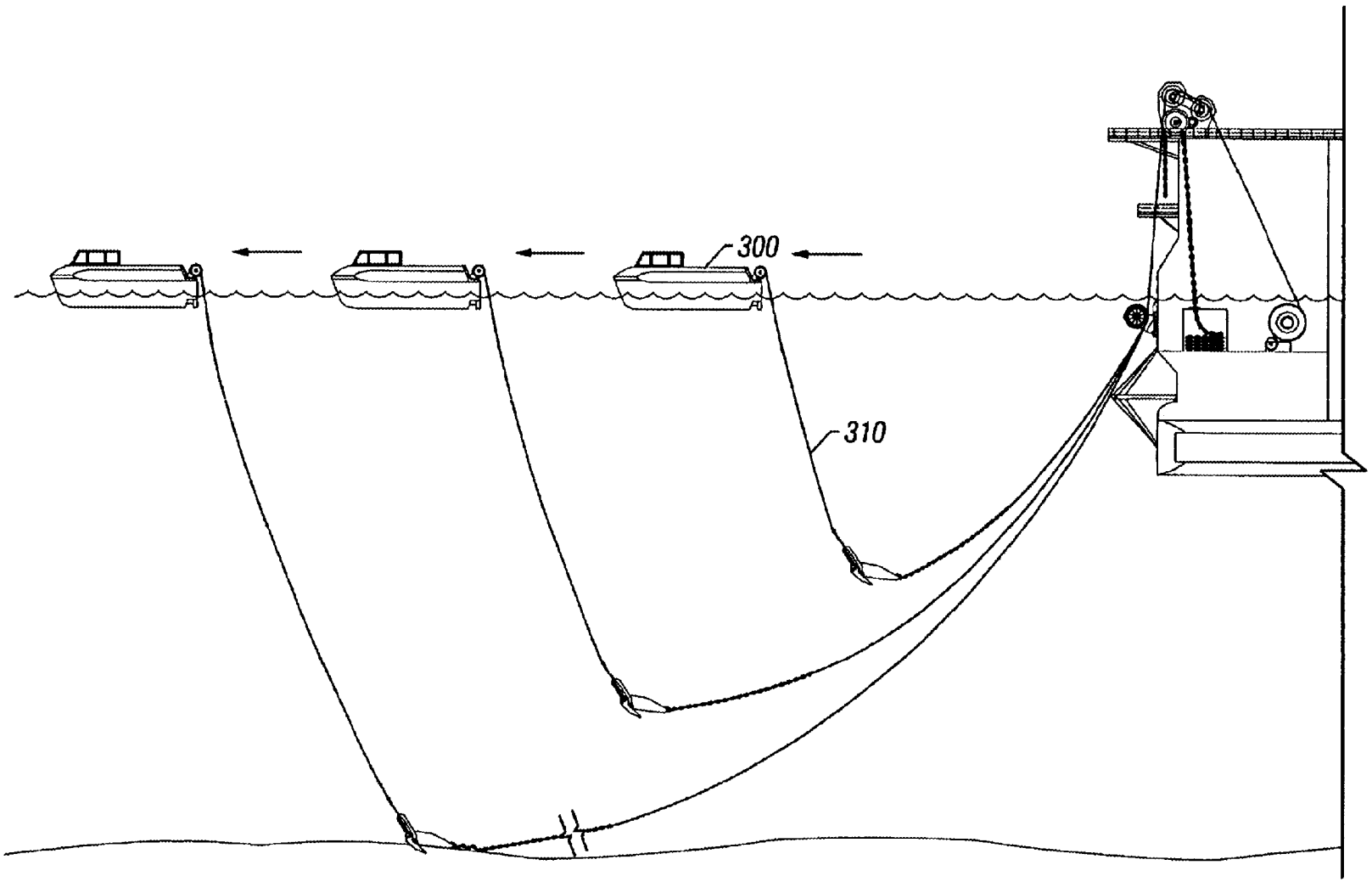
FIG. 3A (Prior Art)
FIGS. 3A and 3B show an anchor handling boat taking the anchor out to place it and bringing the chaser line back to the drilling platform.
Figure 3B:
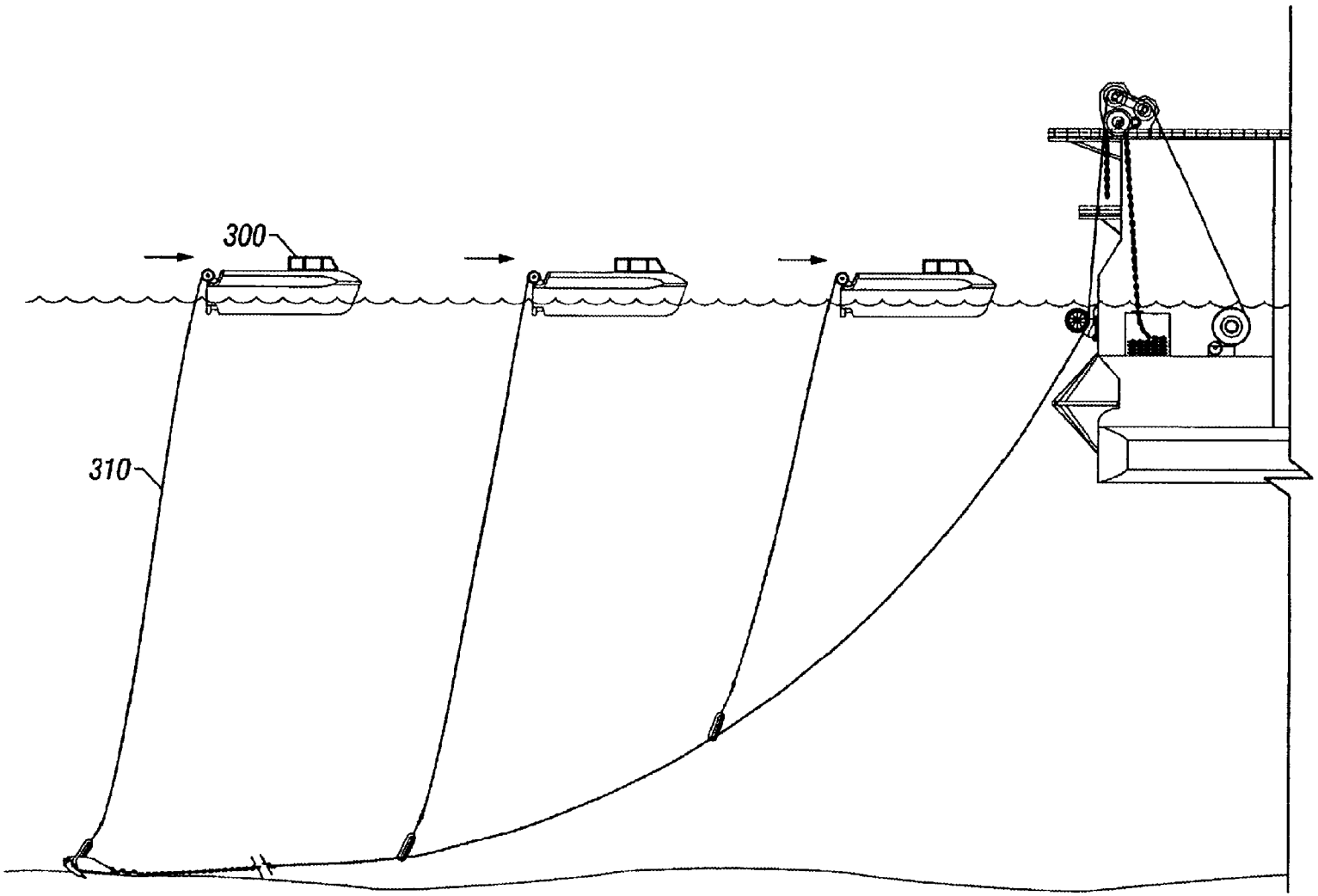
FIG. 3B (Prior Art)
Figure 4:
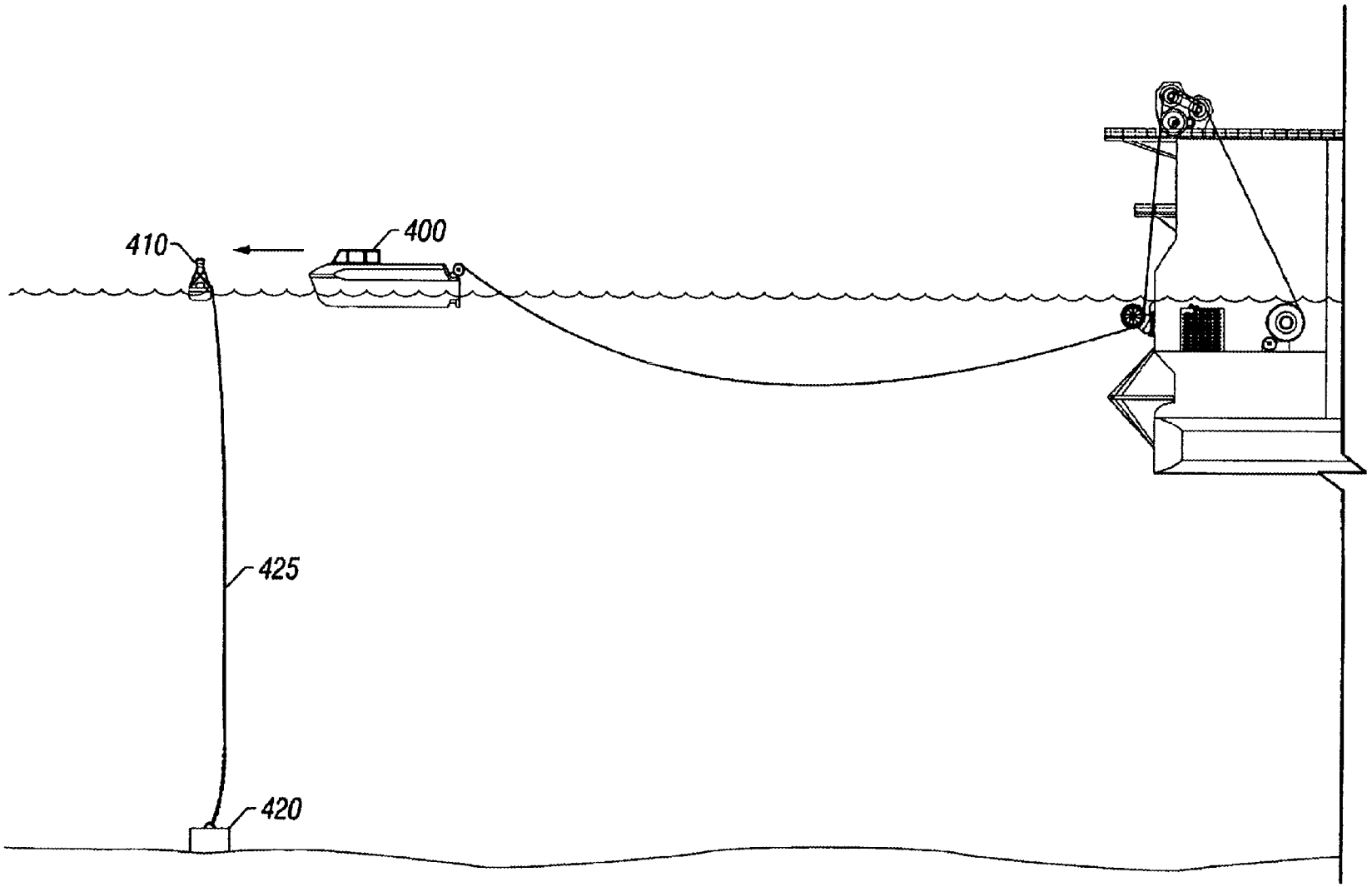
FIG. 4 shows an anchor handling boat carrying wire cable out for attachment to a preset attachment point.
Figure 5A:
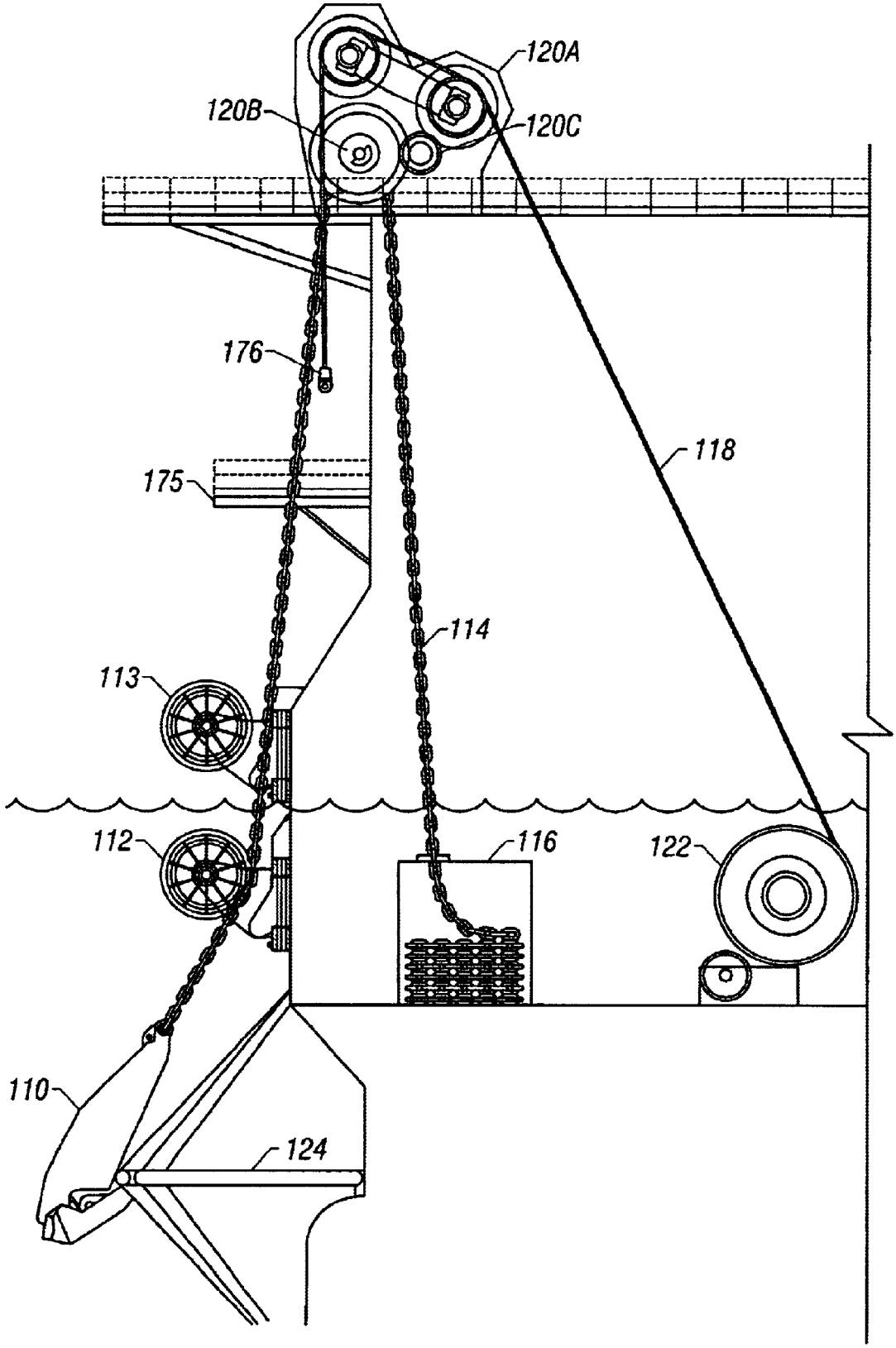
FIGS. 5A–C show an embodiment of the disclosed mooring system from a close-up of the side of the rig and from above the drilling rig.

FIG. 5A shows an embodiment of the disclosed mooring system, similar to the prior art drawing of FIG. 1B. The only additional piece of equipment found here is fairlead 113. This new fairlead 113 is positioned so that it is above and laterally offset from fairlead 112. They are both positioned such that the fleet angles of either wire or chain at each fairlead does not exceed manufacturer imposed limits and the range of angular deployment of wire and chain at each fairlead is able to accommodate a sixteen point system in a range of spread arrangements. Additionally, upper fairlead 113 must also have a reasonable range of movement with the anchors 110 racked in the bolsters 124 and chain 118 running through the lower fairlead 112 to the windlass. Both the traction winch 120A and the windlass 120B of combination traction winch/windlass 120 are now able to use either of fairleads 112 or 113. In any combination of wire, chain and fairlead, the combination traction winch/windlass 120 and its foundation must be strong enough to support the breaking loads of both wire and chain acting on different fairleads simultaneously. This requirement necessitates a heavier version of the combination traction winch/windlass units than was previously used for the same weight of wire and chain. In other words, a prior art traction winch/windlass unit may have been designed to withstand a force equal to the breaking load of a wire or chain, for example 750 tons. Under the present invention, it would now need to be able to withstand 1,500 tons. When maximum mooring lines are disposed, one mooring line will be controlled from each traction winch 120A, another from each windlass 120B.

Figure 5B:
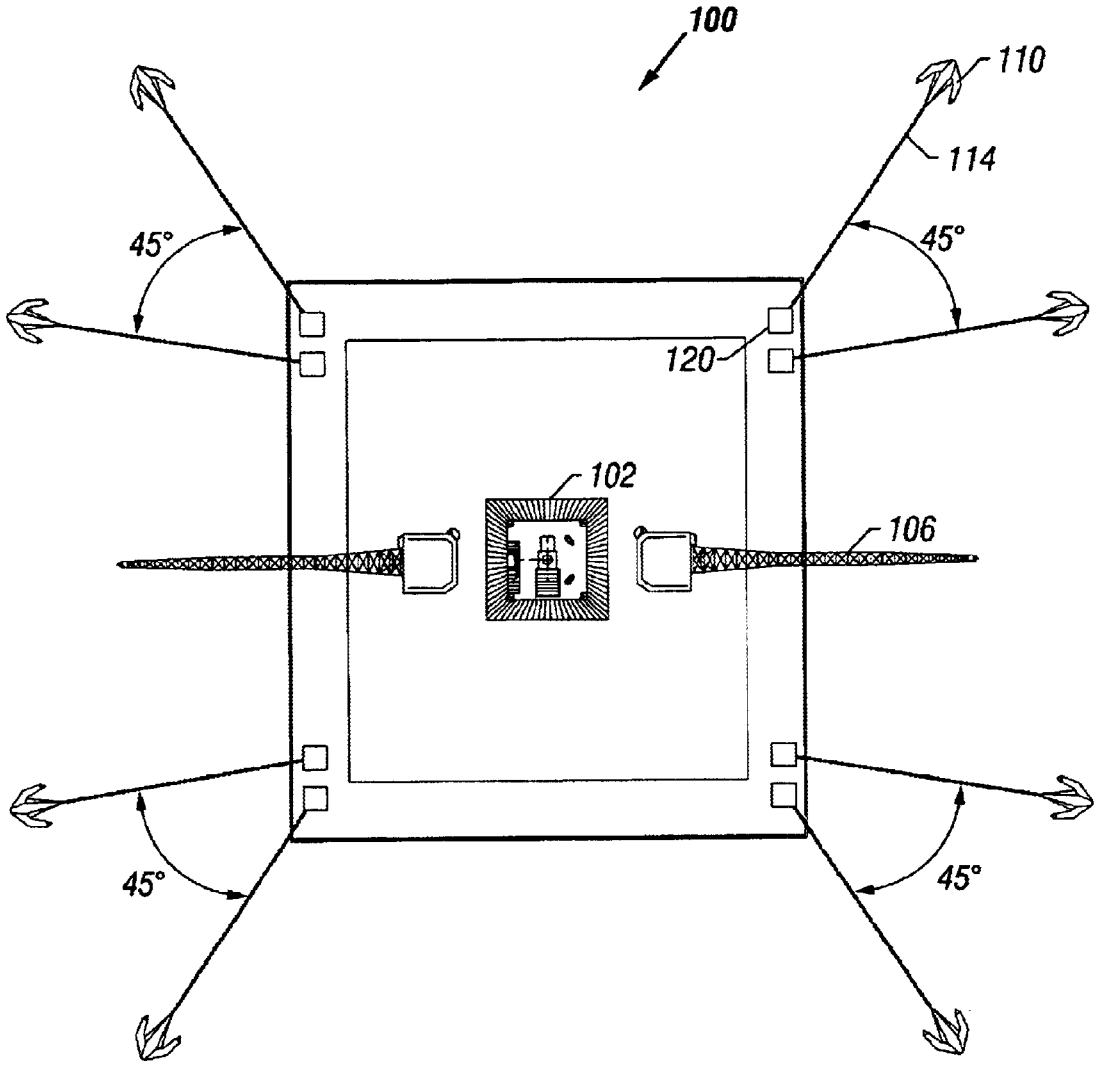
Figure 5C:
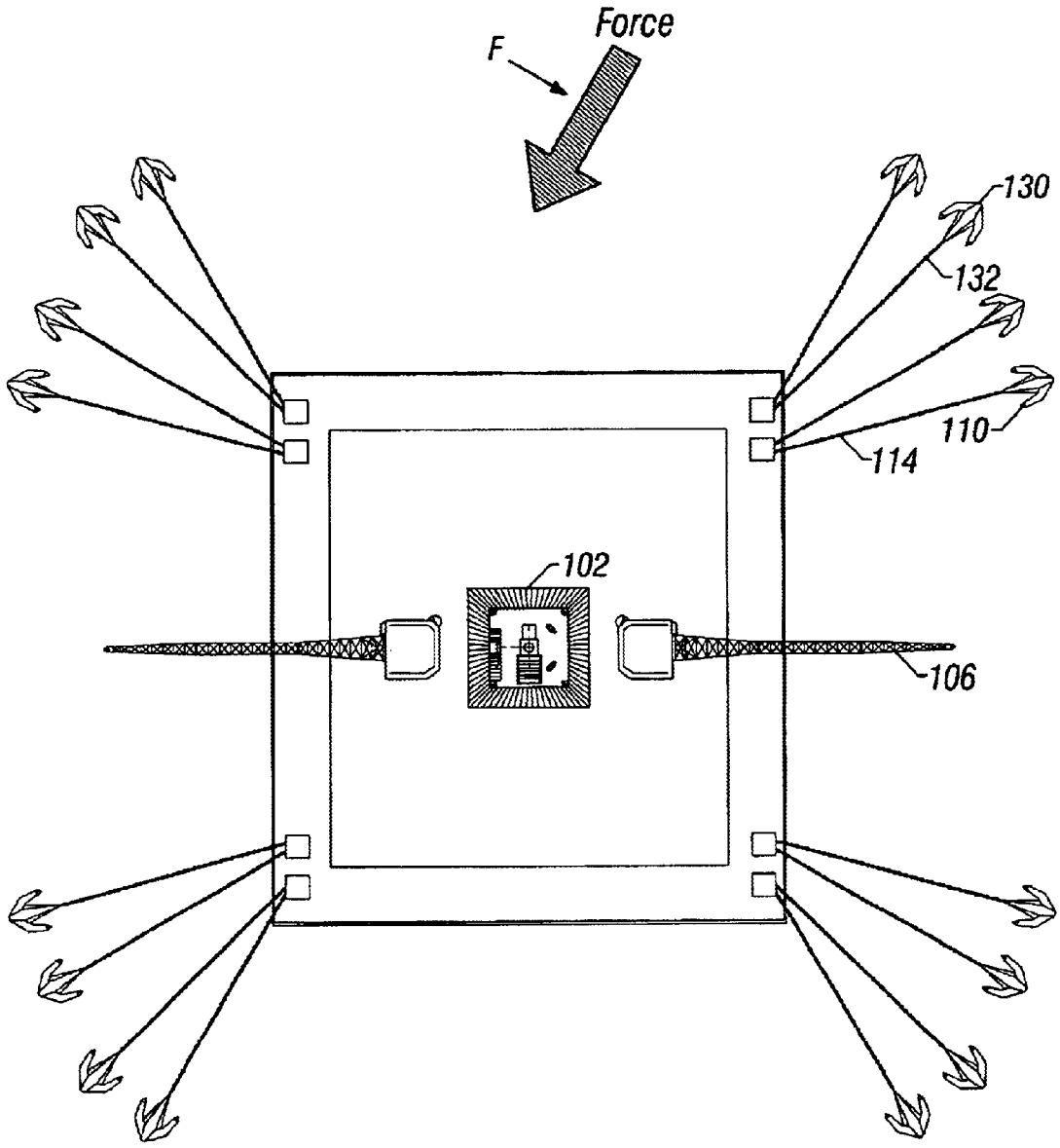

FIG. 5B shows the semi-submersible drilling platform rig from above, with eight mooring lines deployed with a symmetrical spacing of approximately 45 degrees. FIG. 5C shows eight additional lines positioned between each of the original pairs of mooring lines. With all sixteen mooring lines in place, this system will allow the semi-submersible drilling platform to withstand a substantial hurricane, shown here as force F, acting on the platform. A rig equipped according to embodiments of the invention requires no heavier a chain or cable than previously used, nor does it need the larger support boats to handle such heavier chain or cable, nor does it need an extra winch that would only be used in certain areas of the world in certain seasons, yet it can effectively double its mooring capacity when needed. These additional lines can be deployed without disturbing the rig's normal system, saving considerable time over a conventionally equipped rig.

Figure 6A:
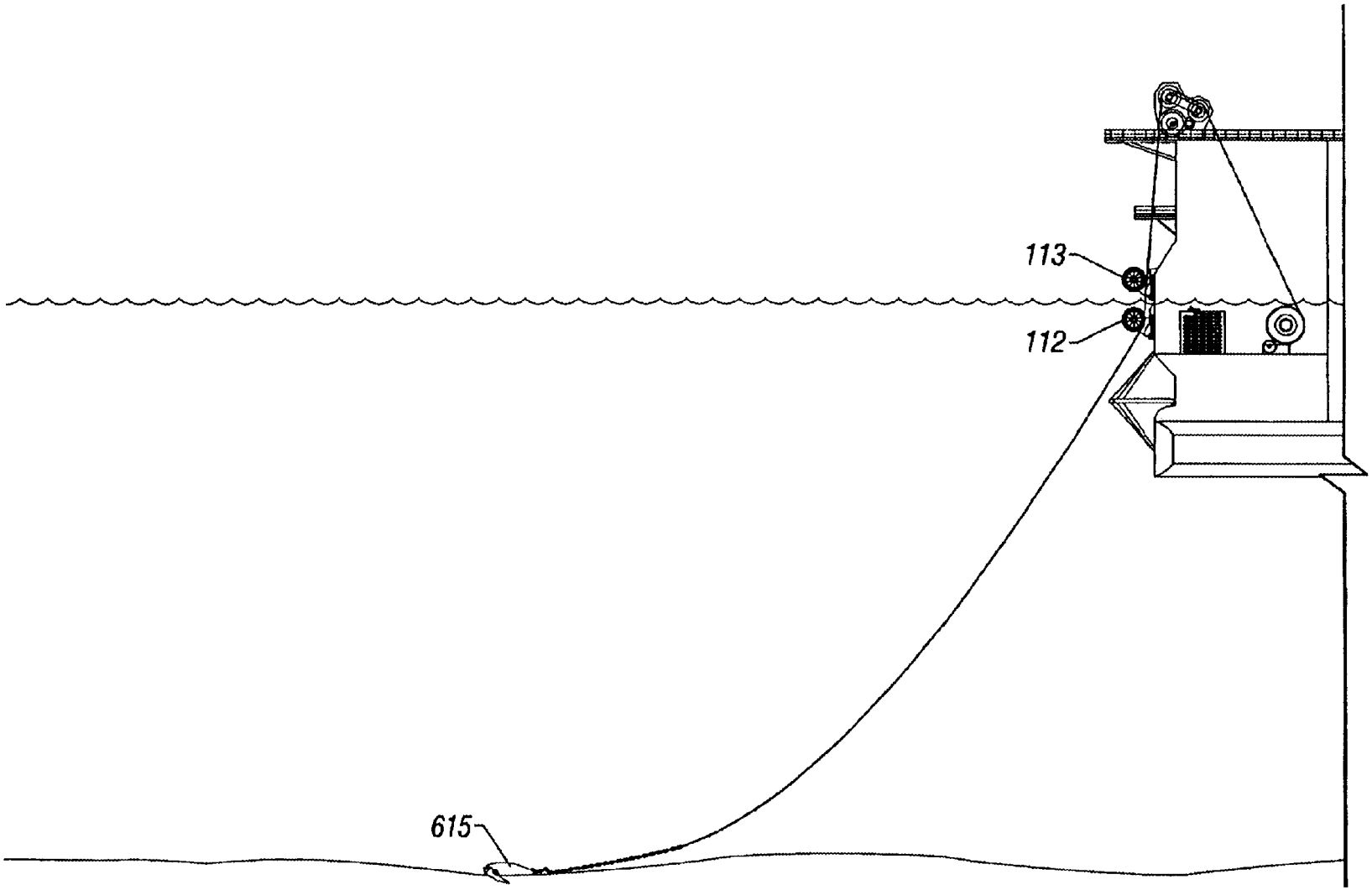
FIGS. 6A–C show an embodiment of the disclosed mooring system as the second set of in is deployed.
Figure 6B:
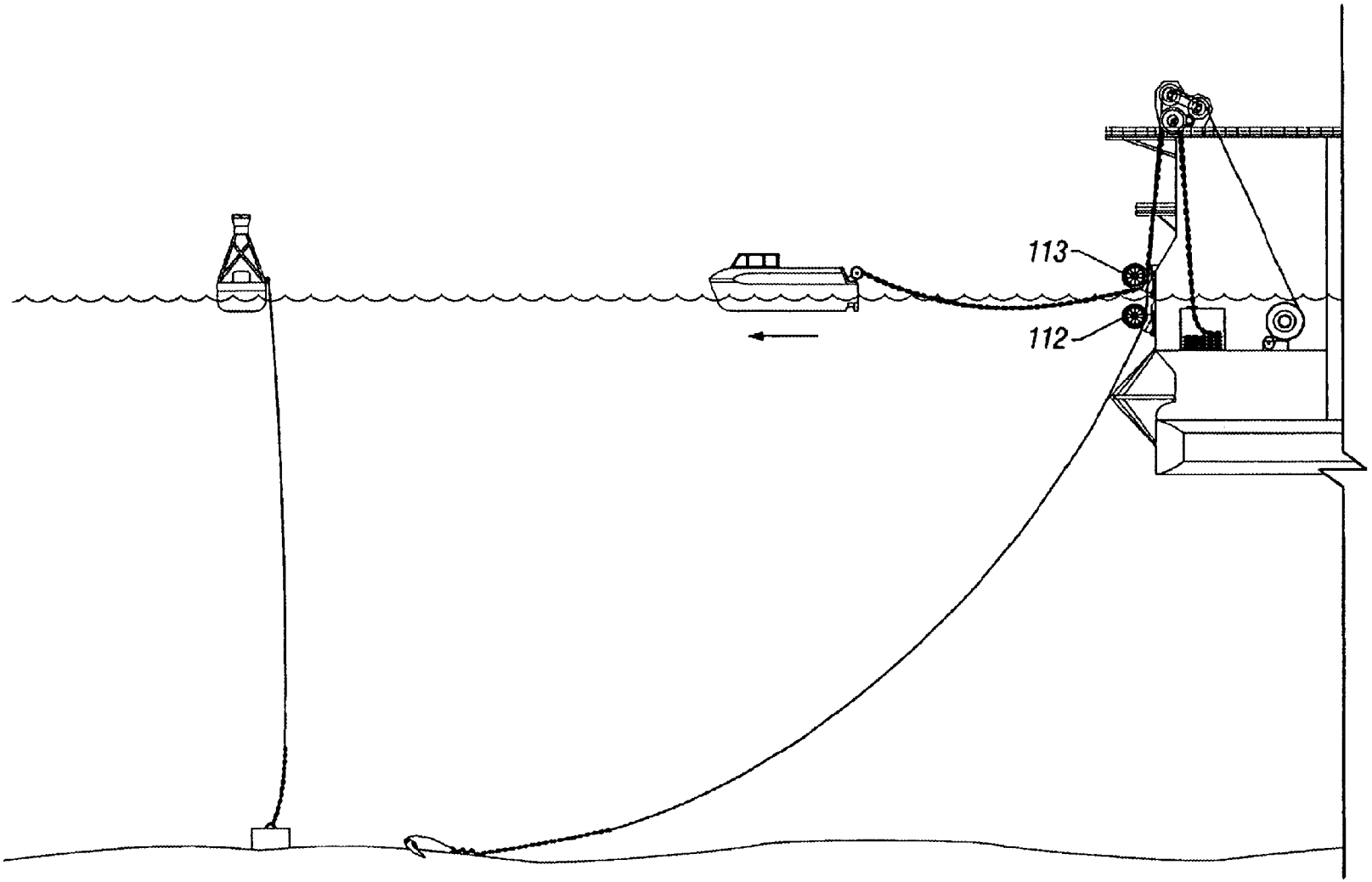
Figure 6C:
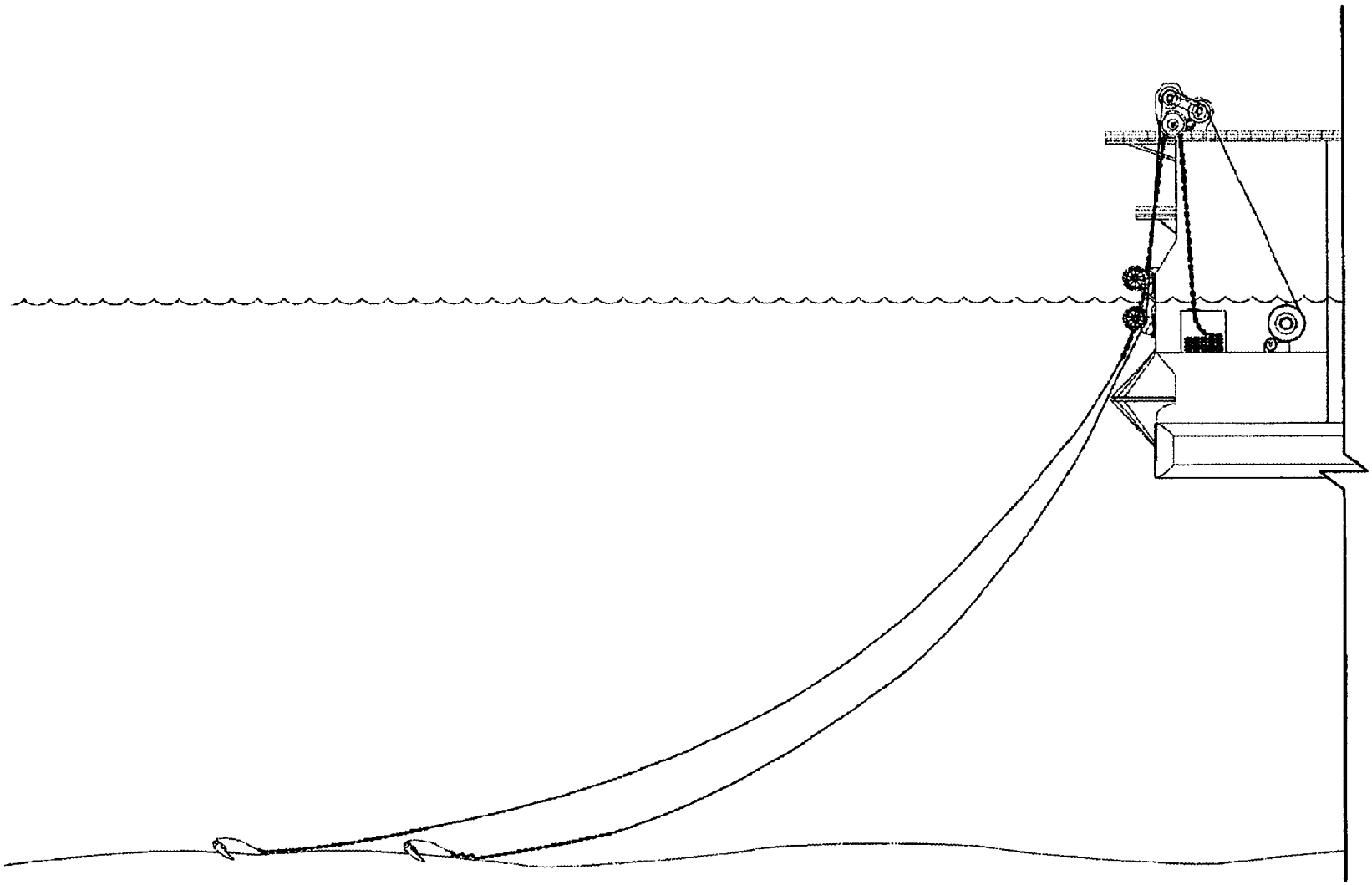

With reference now to FIGS. 6A–C, we see an exemplary embodiment of a semi-submersible drilling platform employing the disclosed mooring system. For the sake of this example, semi-submersible drilling platform 100 will be anchored in a water depth for which it carries adequate mooring lines, in our example, less than 5,000 feet. We will also assume that the rig is located in an area subject to hurricanes, but arrives months before hurricane season will begin. The operator of the semi-submersible drilling platform elects to use the eight onboard anchors 615 for mooring. These anchors 615 are deployed when the rig arrives on location, using an anchor-handling boat. As previously described, anchor 615 is deployed with chain attached directly to the anchor, then wire rope connected to the chain and run out through the lower fairlead 112. So far, the deployment is the same as in the prior art, and is seen. in FIG. 6A.

Sometime between the arrival of the rig and the beginning of hurricane season, the operator of the rig will make arrangements for four or eight additional anchors and associated mooring line to be sent out to the semi-submersible drilling platform, along with at least one anchor-handling boat. As seen in FIG. 6B, these anchors, with appropriate mooring line, are set out by the anchor-handling boat, which then brings the mooring line back to the semi-submersible drilling platform, where it is connected to additional chain that runs over the windlass 120B and under fairlead 113. Of course, the anchors may be similar to the rig's own anchors, but may also be similar to the pre-set anchors described above. FIG. 6C shows the additional mooring line in place, after existing slack has been removed.

Figure 7A:
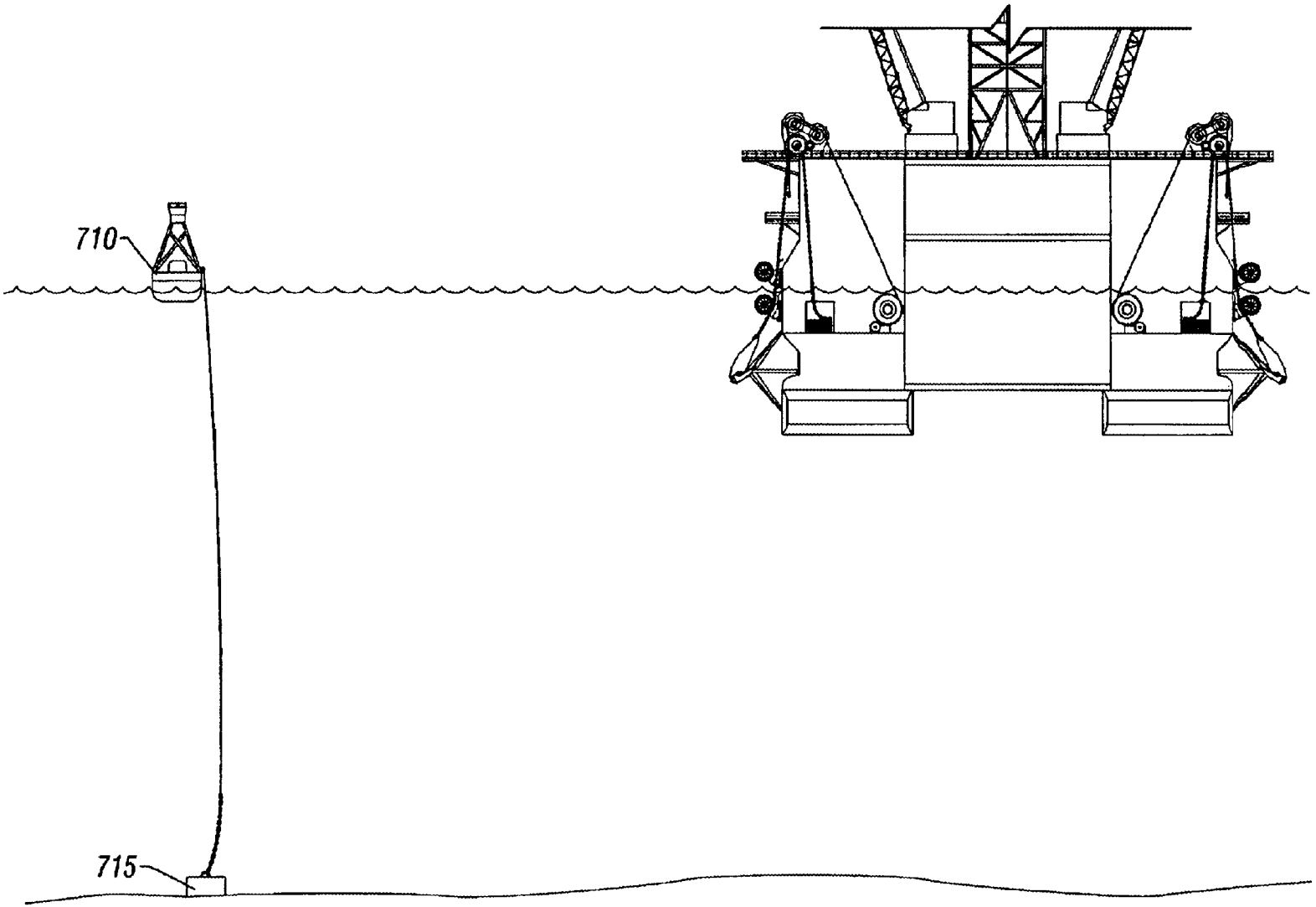
FIGS. 7A–D show an alternate embodiment of the disclosed mooring system on arrival at the site, after the normal mooring lines have been attached, after storm anchors have been set, and after the storm mooring lines have been deployed.
Figure 7B:
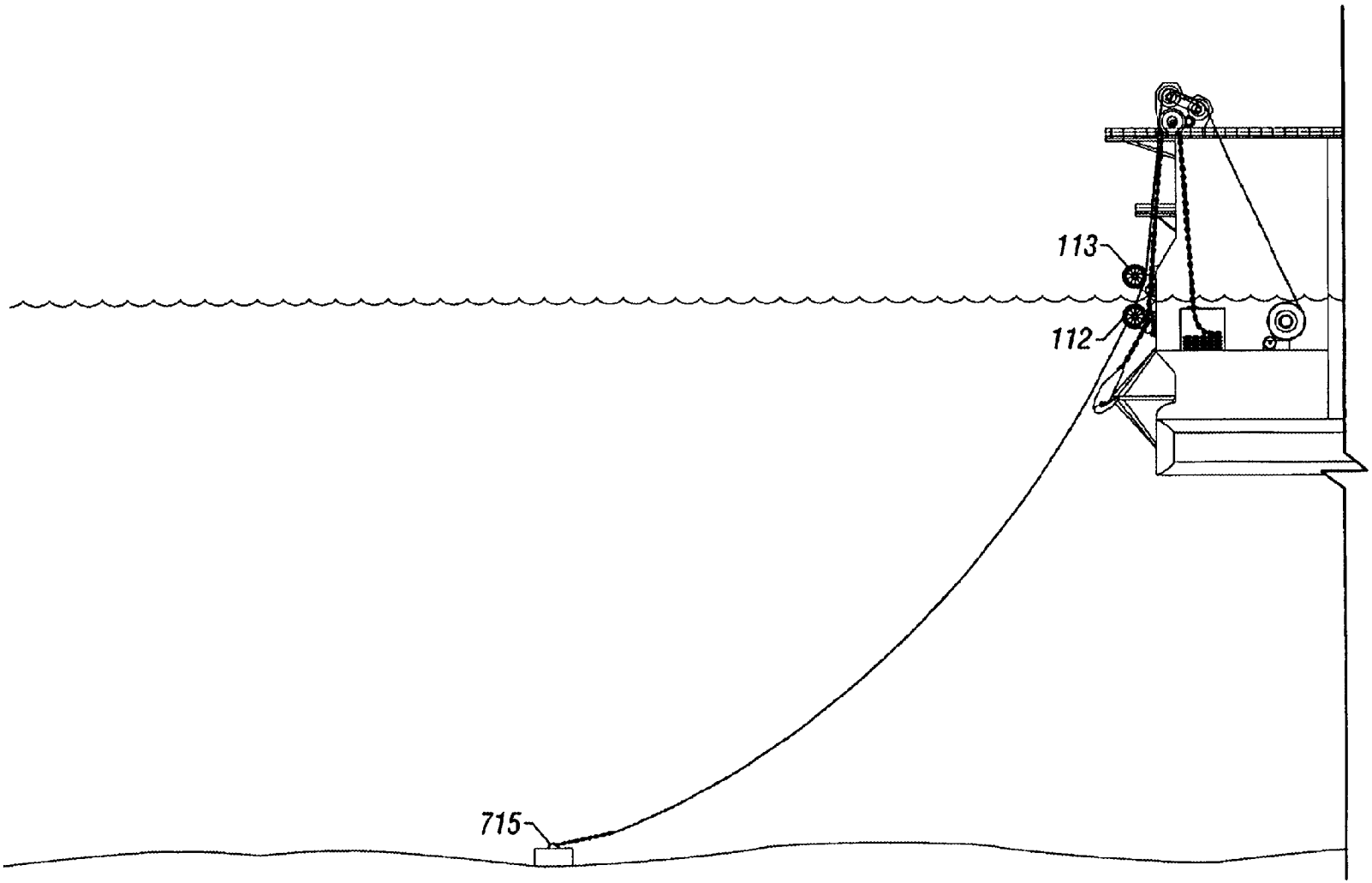
Figure 7C:
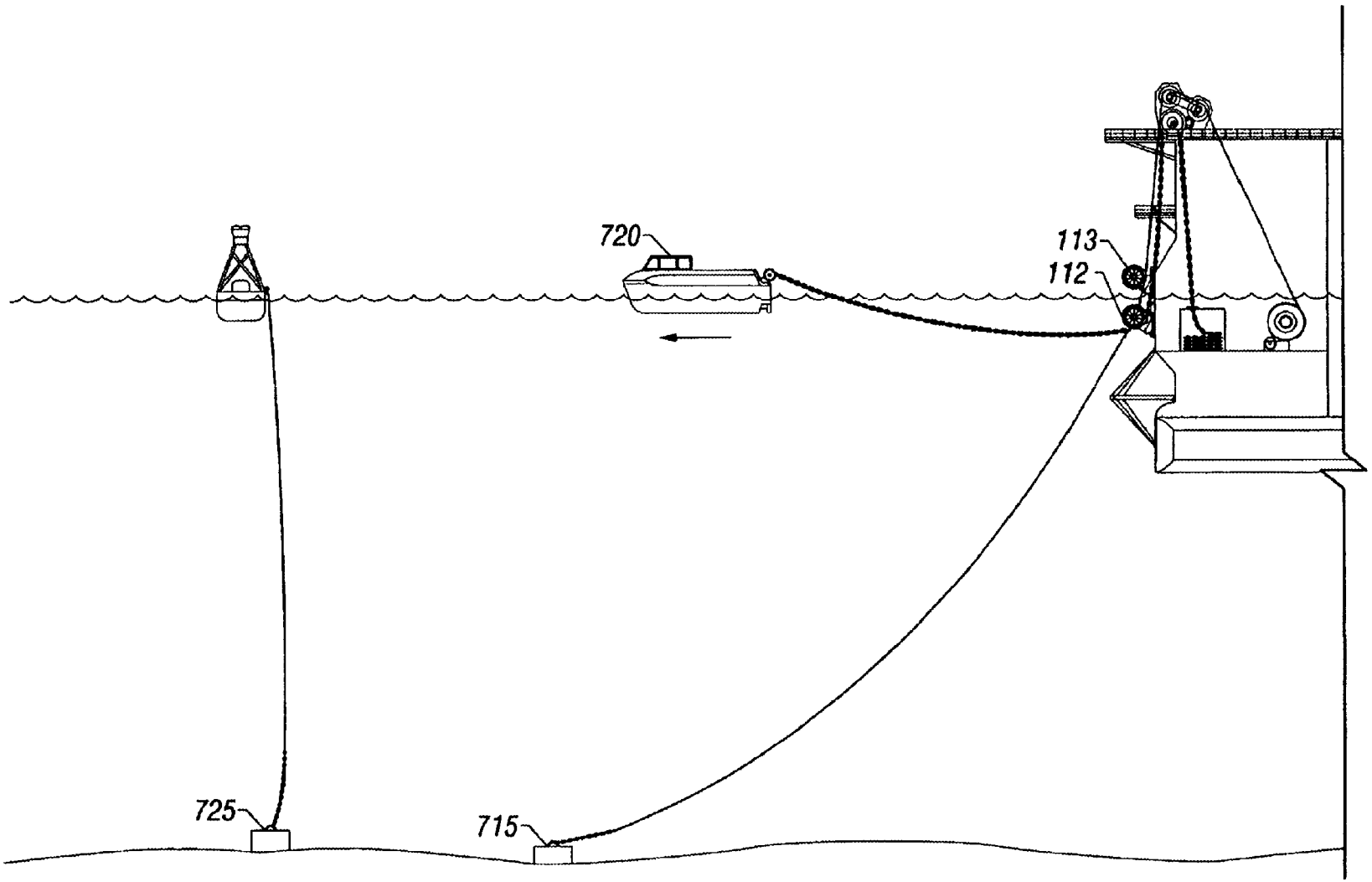
Figure 7D:
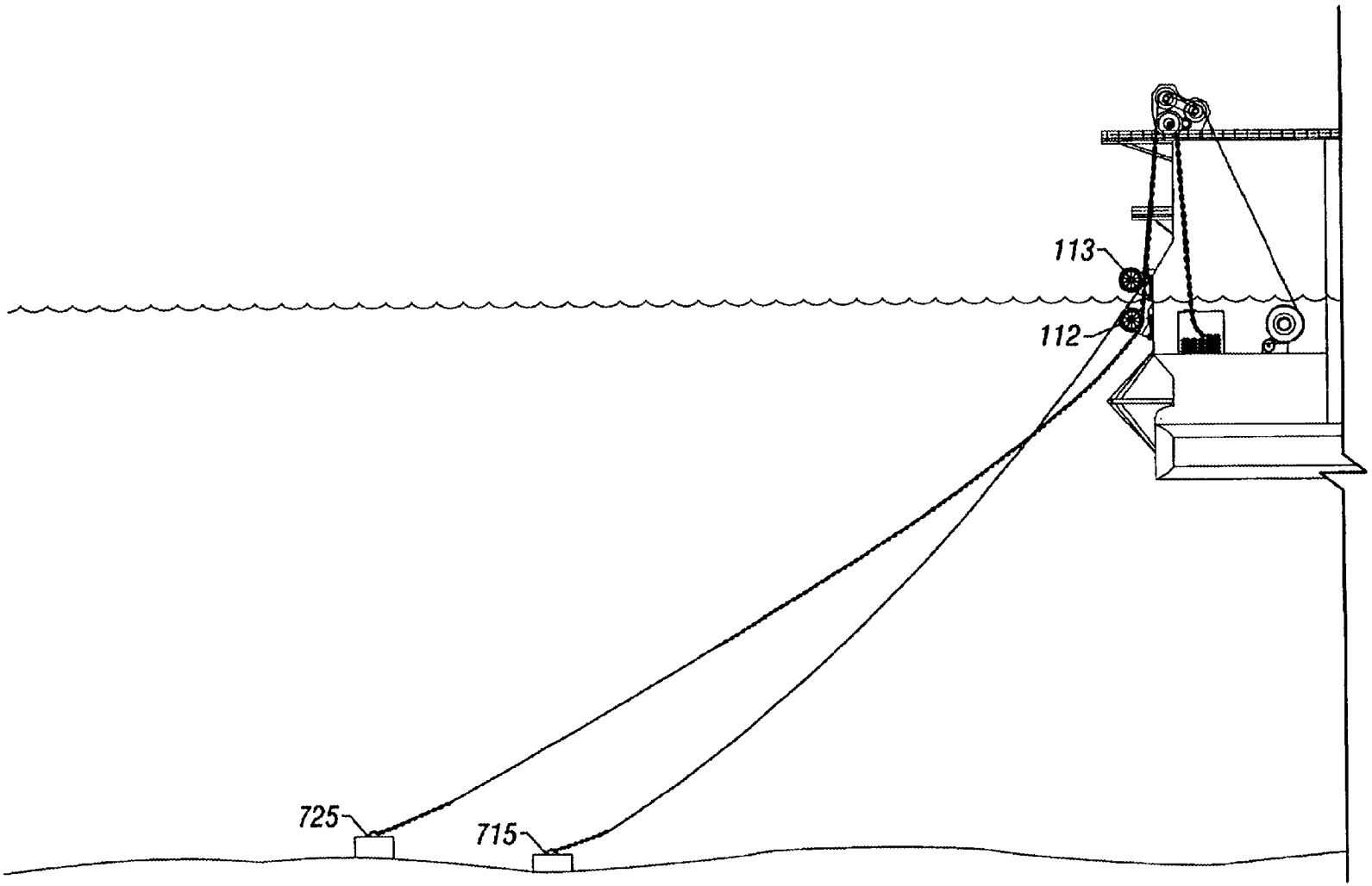

FIGS. 7A–C show an alternate embodiment of the disclosed mooring system. Again, for the sake of discussion, the rig will be located at a deep-water site, greater than the capacity of the onboard system to handle or at a site at which the operator elects to use pre-set moorings rather than the rig's own mooring system. It is also assumed the rig will arrive in a hurricane-prone area, but during the off-season for hurricane activity. The operator arranges for preset anchors, such as suction pile or drag embedment anchors, to be set before the rig is to arrive. In FIG. 7A, the rig has arrived on location, where anchors 715 have been placed (only one is seen). A buoy 710 is connected to anchor 715 by some combination of chain, wire rope and synthetic rope. In FIG. 7B, the normal mooring has been established by connecting cable from the semi-submersible drilling platform to the cable end at buoy 720. Note that because the onboard anchors 110 are not used in this embodiment, they remain racked, with their normal chain attachment through lower fairlead 112. Thus, the attachment to buoy 715 is through upper fairlead 113. This arrangement saves the time, and therefore expense, of detaching anchor 110 and storing it. If there is no reason to use additional mooring capabilities because of location or season, the anchor may remain bolstered during the entire stay on location.

However, in our example, the operator will want to prepare for hurricane season. As the schedule permits, the operator will arrange for additional deep-water anchors 725 to be set. As these are set, a boat will bring the mooring line from the anchor to the semi-submersible drilling platform. In anticipation for this, anchors 110 have been removed from their bolsters and stored, although chain will remain run under fairlead 112. Mooring line 730 from the deep-water anchor is attached to chain 114A to complete the deployment of additional mooring lines, illustrated in FIG. 7C.

The description of the present invention has been presented for purposes of illustration and description, but is not to be assumed to be exhaustive, nor is the invention intended to be limited to the form disclosed. Many modifications and variations will be apparent to those of ordinary skill in the art.

For example, the application discloses using traction winches, however, other types of winches can be used without going outside the scope of the invention.

Figure 8A:
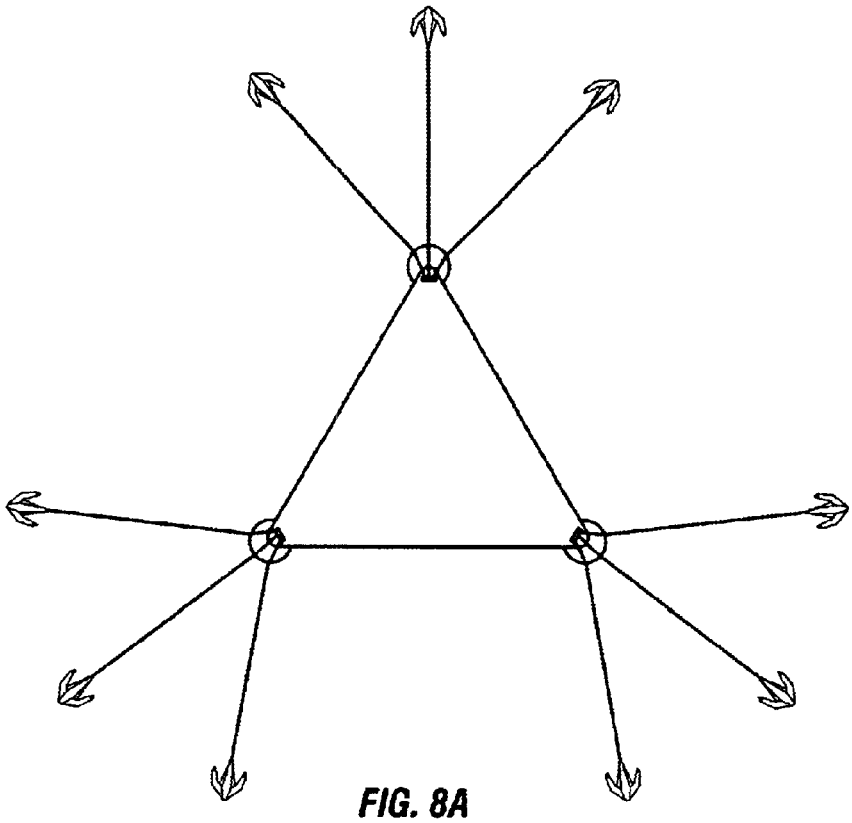
Figure 8B:
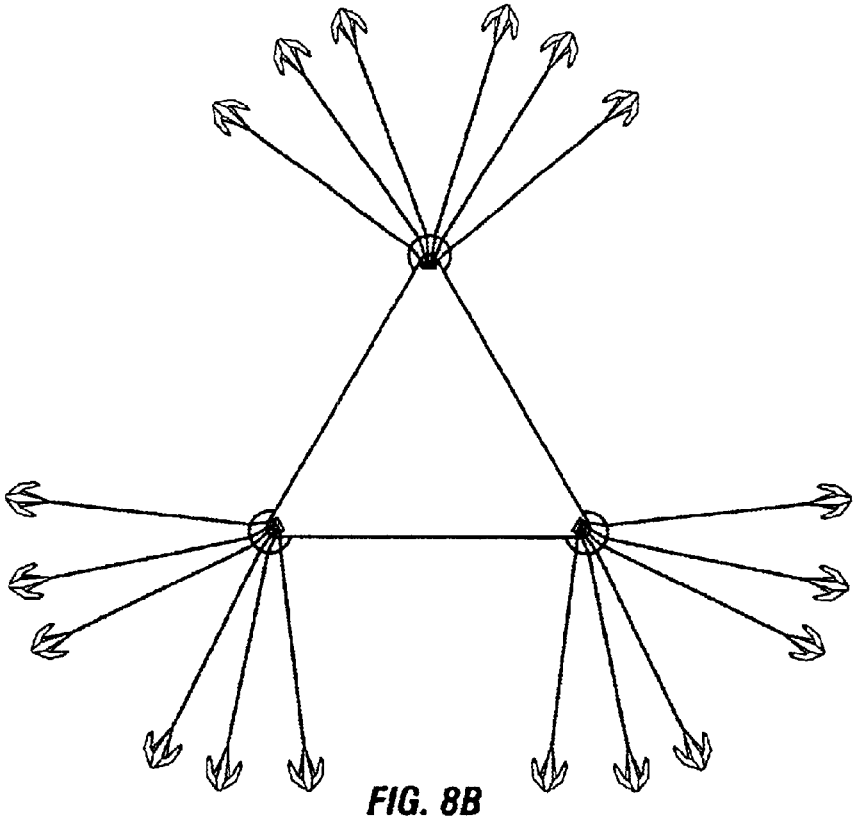
FIG. 8B shows that alternate embodiment with storm lines deployed.

Additionally, the disclosed embodiment shows eight traction winch/windlass units combined in pairs, with each pair of traction winch/windlass units sharing a common drive system. In an alternate embodiment, nine traction winch/windlass units can be arranged in threes, with a common drive unit for each set of three, as shown in FIG. 8A, which shows an overhead schematic of the nine units with normal anchors deployed. The deployment of storm anchors for this embodiment is shown in FIG. 8B.

In further embodiments, other types of mooring lines can be employed, or other anchors substituted for those mentioned.

The embodiment was chosen and described in order to best explain the principles of the invention to enable others of ordinary skill in the art to understand the invention for various embodiments with various modifications as are suited to the particular use contemplated.

We claim:

1. A mooring system comprising:

a plurality of combination winch/windlass units, attached to a floating offshore structure;

a first set of fairleads, attached to the floating offshore structure, wherein a first set of mooring lines can be deployed from each combination traction winch/windlass unit, through said first set of fairleads, said first set of mooring lines providing adequate mooring during normal conditions but not during a period when tropical revolving storms are expected in the region of said floating structure; and a second set of fairleads attached to the floating offshore structure, wherein a second set of mooring lines can be deployed from an unused component of each combination traction winch/windlass unit through said second set of fairleads, said second set of mooring lines and said first set of mooring lines together providing adequate mooring during a period when tropical revolving storms are expected in the region of said floating structure.

2. The mooring system of claim 1, comprising eight combination winch/windlass units arranged in pairs with a common drive system for each pair.

3. The mooring system of claim 1, comprising nine combination winch/windlass units arranged in threes with a common drive system for each triple unit.

4. The mooring system of claim 1, wherein each of said combination winch/windlass units are positioned on a deck of said floating offshore structure above respective fairleads.

5. The mooring system of claim 1, wherein said first set of fairleads is below and laterally displaced from said second set of fairleads.

6. The mooring system of claim 1, wherein said floating offshore structure is a semi-submersible drilling rig.

7. A floating offshore structure, comprising:

a plurality of combination winch/windlass units attached to said floating offshore structure, a first set of fairleads attached to said floating structure, through which a first set of mooring lines are deployed from each combination winch/windlass units, a second set of fairleads attached to said floating offshore structure, through which a second set of mooring lines can be deployed from an unused winch or windlass component of each combination winch/windlass unit wherein said first set of mooring lines provides adequate mooring during normal use but not during a period when tropical revolving storms are-expected in the region of said floating structure and said first set of mooring lines in combination with said second set of mooring lines provides adequate mooring during a period when tropical revolving storms are expected in the region of said floating structure.

8. The floating offshore structure of claim 7, comprising eight combination winch/windlass units arranged in pairs with a common drive system for each pair.

9. The floating offshore structure of claim 7, comprising nine combination winch/windlass units arranged in threes with a common drive system for each triple unit.

10. The floating offshore structure of claim 7, wherein each of said combination winch/windlass units are positioned on a deck of said drilling rig above respective fairleads.

11. The floating offshore structure of claim 7, wherein said first set of fairleads is below and laterally displaced from said second set of fairleads.

12. The floating offshore structure of claim 7, wherein said floating offshore structure is a semi-submersible drilling rig.

13. The floating offshore structure of claim 7, further comprising a plurality of anchors attached to said floating offshore structure through chain run over a windlass portion of said winch/windlass units.

14. A method of securing a floating offshore structure, comprising the steps of: mooring mooring said floating offshore structure using a first set of mooring lines deployed through a plurality of winch-and-windlass units and a first set of fairleads;

under a given set of conditions, adding a second set of mooring lines deployed through unused components of said plurality of winch-and-windlass units and a second set of fairleads;

wherein deployment of said first set of mooring lines provides adequate mooring during normal use, but not during a period when tropical revolving storms are expected in the region of said floating structure;

wherein deployment of said first mooring lines in combination with said second mooring lines provides adequate mooring during a period when tropical revolving storms are expected in the region of said floating structure.

15. The method of claim 14, wherein said floating offshore structure is a semi-submersible drilling rig.

16. The method of claim 14, wherein said mooring step moors said floating offshore structure using anchors carried onboard said floating offshore structure.

17. The method of claim 14, wherein said mooring step moors said floating offshore structure using preset anchors.

18. The method of claim 14, wherein said mooring lines comprise some combination of chain, wire rope, and synthetic rope.

* * * * *